US006497497B1

(12) United States Patent
Ahroni

(10) Patent No.: US 6,497,497 B1
(45) Date of Patent: Dec. 24, 2002

(54) DECORATIVE LIGHT ASSEMBLY

(76) Inventor: Joseph M. Ahroni, 2701 W. Manor Pl., No. 204, Seattle, WA (US) 98199

( * ) Notice: Subject to any disclaimer, the term of this patent is extended or adjusted under 35 U.S.C. 154(b) by 0 days.

(21) Appl. No.: 09/620,762

(22) Filed: Jul. 21, 2000

(51) Int. Cl.[7] ..... F21V 21/14
(52) U.S. Cl. ..... 362/250; 362/227; 362/239; 362/252
(58) Field of Search ..... 362/250, 227, 362/238, 239, 249, 252

(56) References Cited

U.S. PATENT DOCUMENTS 1,989,869 A * 2/1935 Kohn ..... 40/427
6,132,063 A * 10/2000 Byers ..... 362/252
6,203,166 B1 * 3/2001 Byers ..... 362/121

* cited by examiner

*Primary Examiner*—Stephen Husar
*Assistant Examiner*—Ronald E. DelGizzi
(74) *Attorney, Agent, or Firm*—Seed IP Law Group PLLC

(57) ABSTRACT

A lighting fixture has a plurality of coaxial round or other shaped rings on which a string of miniature lights is mounted. The rings are spaced apart when the fixture is in an active position and are stacked relatively close together when collapsed into a storage position. Slide links or the like interconnect the rings and limit expansion of the fixture into its active position.

12 Claims, 6 Drawing Sheets

DECORATIVE LIGHT ASSEMBLY

TECHNICAL FIELD

The present invention relates to a light fixture utilizing miniature light units mounted on a cord fitted on the fixture.

BACKGROUND OF THE INVENTION

Various lanterns and special lighting are popular for illuminating and decorating indoor and outdoor living areas, particularly for parties and special occasions. A need exists for improved lighting fixtures which incorporate miniature light strings in an eye-pleasing manner and which can be readily collapsed for compact storage or shipping without disassembling parts thereof.

SUMMARY OF THE INVENTION

The present invention meets this need by providing a fixture having multiple mounting rings adjustably connected together, one above another, so that the rings can be easily collapsed toward one another to a storage position from an active position in which they are spread apart in coaxial relation. A light string with multiple miniature lights on a cord is mounted on the rings so that the lights radiate from the rings and the cord continues from ring to ring. The rings may be interconnected by flexible elements slidably mounted between adjacent rings to limit spreading apart of the rings without restricting collapsing of the fixture when desired. The rings can have various shapes and sizes so that the lights on the fixtures are arranged to provide a variety of attractive displays.

DETAILED DESCRIPTION OF THE INVENTION

Figure 1:
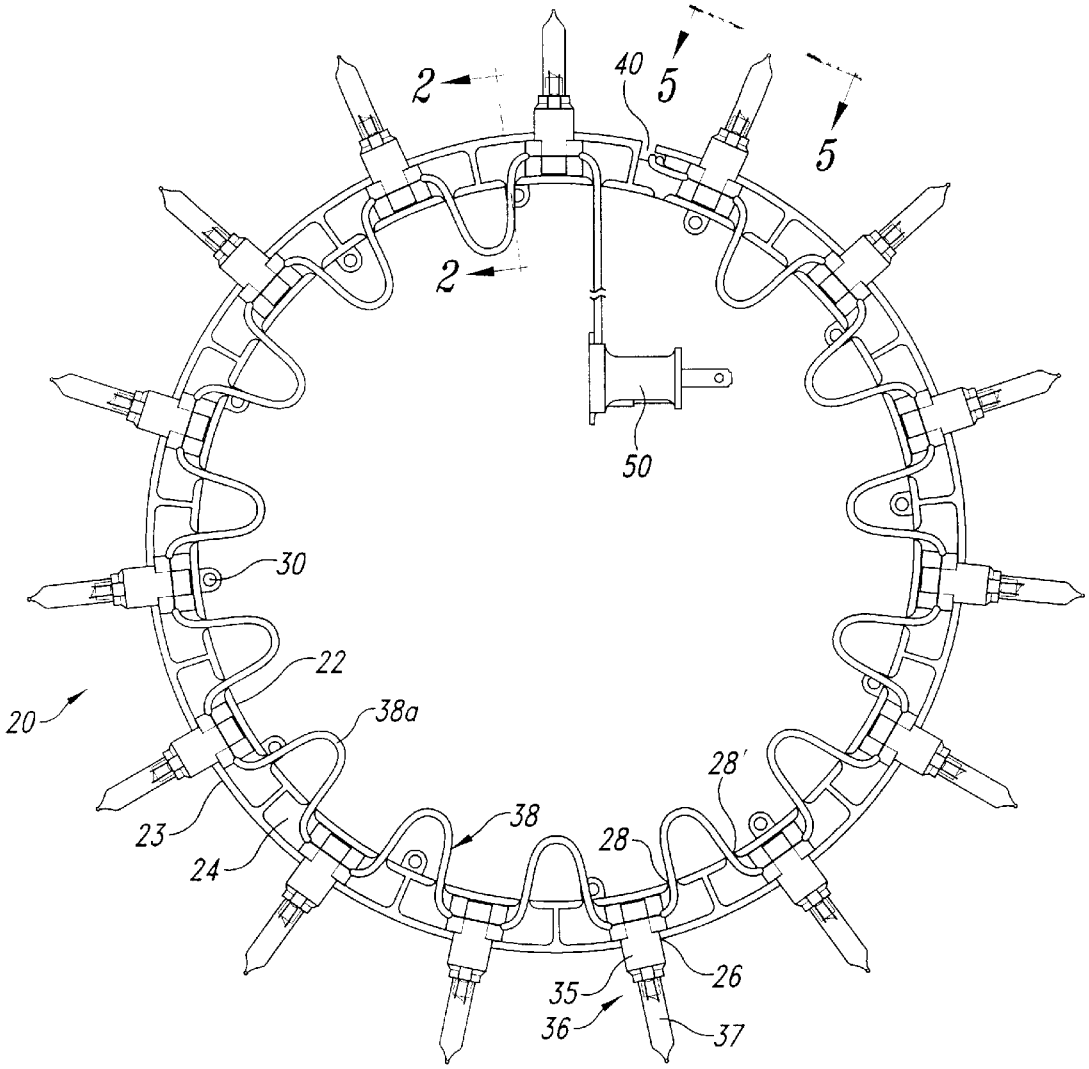
FIG. 1 is a plan view of one of the fixture rings of the invention with part of a light string mounted thereon.
Figure 2:
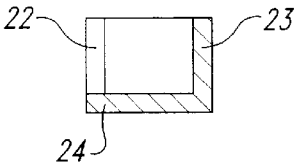
FIG. 2 is a transverse sectional view of the ring taken as indicated by lines 2—2 in FIG. 1.
Figure 3:
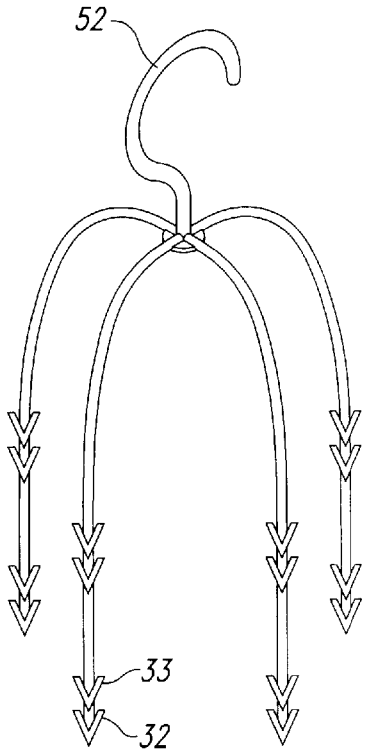
FIG. 3 is a perspective view of one of the hanger units.

Referring to the drawings it is seen that the light fixtures of the present invention have a light supporting framework which is collapsible from an expanded active position to a collapsed inactive or storage position along a normally generally vertical axis. The primary structural members in the framework are mounting members for supporting light units, and these members are preferably in the form of circular rings, but may be other endless shapes such as polygonal, square or hexagonal for example, or can be open ended in the form of straight or curved members. In all instances the mounting members are interconnected by suitable expansion limiting elements so that they can expand apart from one another a predetermined distance from a collapsed or retracted position. These elements may take the form of slide links or folding links, or may be flexible links such as a cord tied to adjacent of the mounting members, for example.

Figure 4:
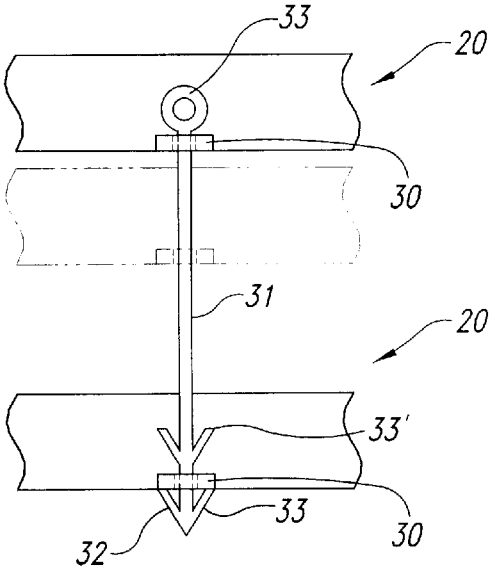
FIG. 4 is a fragmentary elevational view showing the adjustable connection between two adjacent rings and indicating a collapsed fixture condition in phantom.
Figure 5:
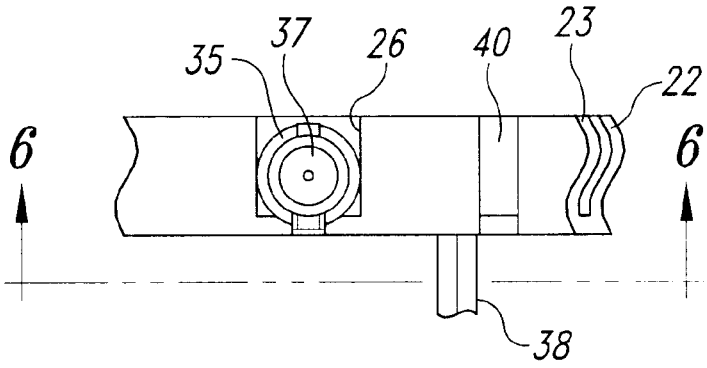
FIG. 5 is a detail side elevational view taken as indicated by line 5—5 in FIG. 1.
Figure 6:
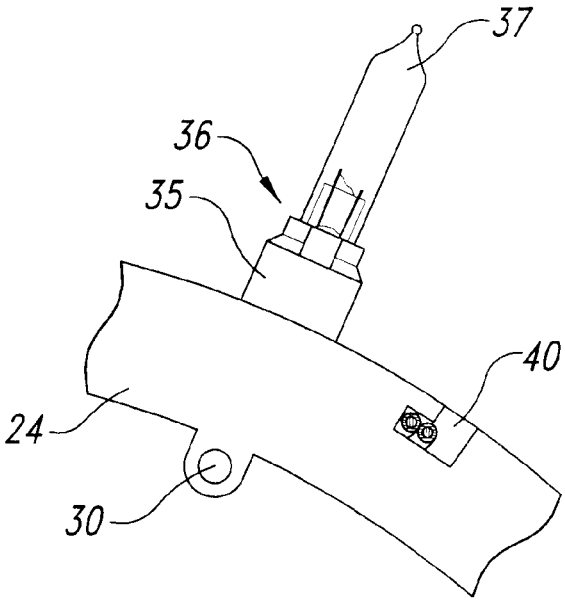
FIG. 6 is a detail bottom view taken as indicated by line 6—6 in FIG. 5.

In the preferred embodiment the mounting members are injection-molded circular plastic rings 20 having a channel-like cross-section providing inner and outer flanges 22–23 and a bottom wall 24. The outer flange 23 has a series of generally rectangular, upwardly open cutouts 26 formed therein, and the inner flange 22 has a pair of upwardly open notches 28–28' located circumferentially between each two adjacent cutouts 26. The rings 20 are also formed with a plurality of retaining eyes 30 projecting radially inward from the base of the inner flange 22 to receive expansion limiting elements in the form of flexible links 31 having a pointed entry head 32 at one end and a stop eye 33 at the other end. The entry head 32 has a pair of flexible barbs 33 which can be pressed together sufficiently to permit the entry head to be passed through one of the retaining eyes 30, and will then spread apart to prevent retraction of the entry head from the retaining eye. The stop eye 33 on each link 31 is large enough to preclude passing of the stop eye through a retaining eye 30. Additional pairs 33' of barbs can be provided on the links 31 to provide a shorter effective length for the links as shown in FIG. 4.

The cutouts 26 in the outer flange of each ring 20 are sized to receive the housings 35 of miniature light units 36 positioned so that their bulbs 37 project radially outward. The light units 36 may be of the push-in type shown for example in U.S. Pat. Nos. 5,829,865 or 6,079,848 and namely units in which the bulbs are mounted in plastic holders which plug into the housings 35 so that filament wires from the bulb engage a pair of contact elements mounted in the housings. These contact elements have pointed ends which pierce through the insulation on opposite sides of a cutout in one of two wires in an electric cord 38 passing through a wireway in the housing. Thus, when the cord is energized, current passes in each light unit to the respective bulb via the contact elements and the interrupted wire. In U.S. Pat. Nos. 5,829,865 and 6,079,848 the cord has three wires passing through the housings of the light units, whereas in the present instance only two wires are required, one serving as the ground and the other being the one with the cutouts between the contact elements.

The light units 36 are preferably equally spaced about each ring 20, and the cord 38 loops radially inward between adjacent units by loops 38*a* which pass through the respective pair of notches 28 in the inner flange 22. Preferably the cord 38 fits snugly in the notches 28.

The outer flange 23 of each ring contain a notch 40 between two of the cutouts 26 which provides cord access to a bottom passage 42 through the bottom wall of the ring. This passage is utilized to position the cord 38 from one ring to a light unit in the next ring after the first ring has been fitted with light units around its circumference. In passing from passage 42 to a light unit in the next ring, the cord 38 preferably passes through an adjacent one of the notches 28 in the next ring 20. The cord enters the ring at one end of the fixture and after it has been manipulated to position light units in all of the rings, the cord can be fed out the infeed end of the fixture or the opposite end. The cord feeds from a wall plug 50 or from a controller powered via a lead from a wall plug. At the opposite end of the cord the two wires in the cord are electrically connected together in an add-on plug or an end connector to complete a series circuit for all of the lights in the fixture.

At one or both ends of the fixture a mounting hook 52 is connected to the end ring by a set of four flexible legs 54 passing through eyes 30 in the end ring. These legs, like the connecting links 32, have a pointed entry head 32 and pairs of flexible retaining barbs 33 for engaging the bottom of the ring eyes 30 to set the distance of the mounting hook 52 from the fixture.

The fixture may be collapsed for compact storage merely by pushing axially from opposite ends. As the rings responsively move axially toward one another as indicated in FIG. 4 the connecting links 32 slide through the ring eyes 30 the required distance to collapse the fixture.

Figure 7:
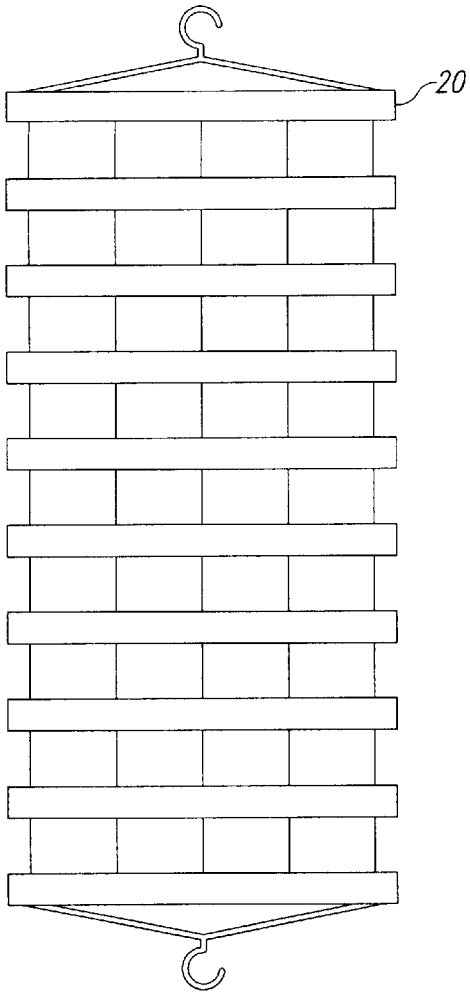
FIGS. 7 and 8 are elevational views showing a fixture in active and collapsed positions having a cylindrical configuration and without the light string and related details being shown.
Figure 8:
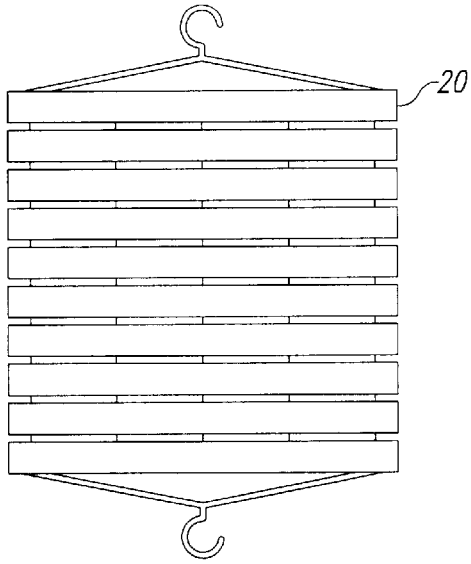
Figure 9:
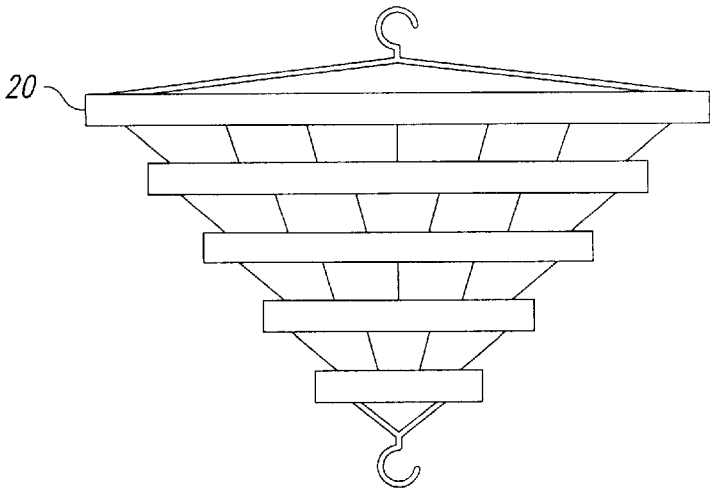
FIGS. 9, 10, 11, and 12 are views like FIG. 7 showing examples of other shapes of fixtures.
Figure 10:
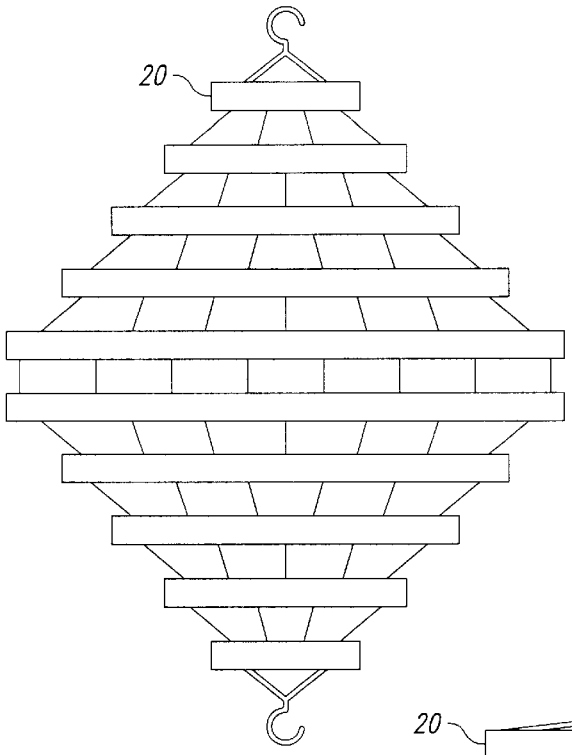
Figure 11:
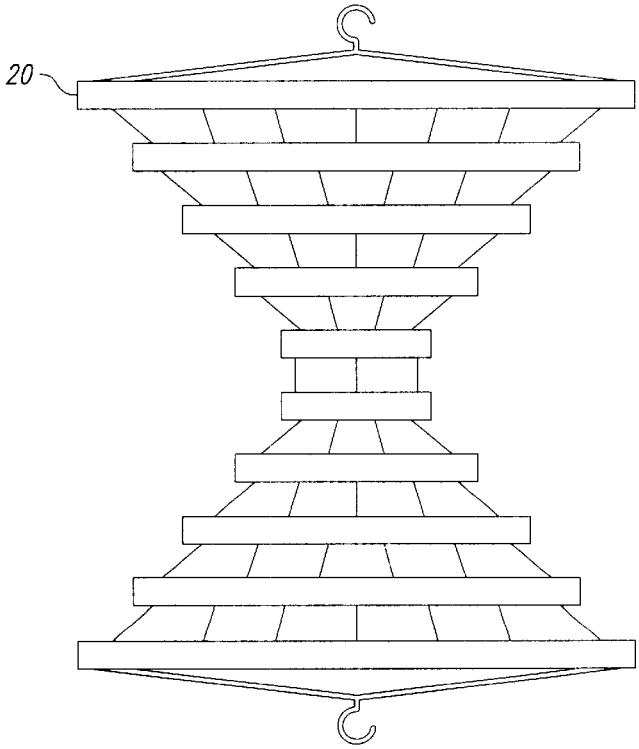
Figure 12:
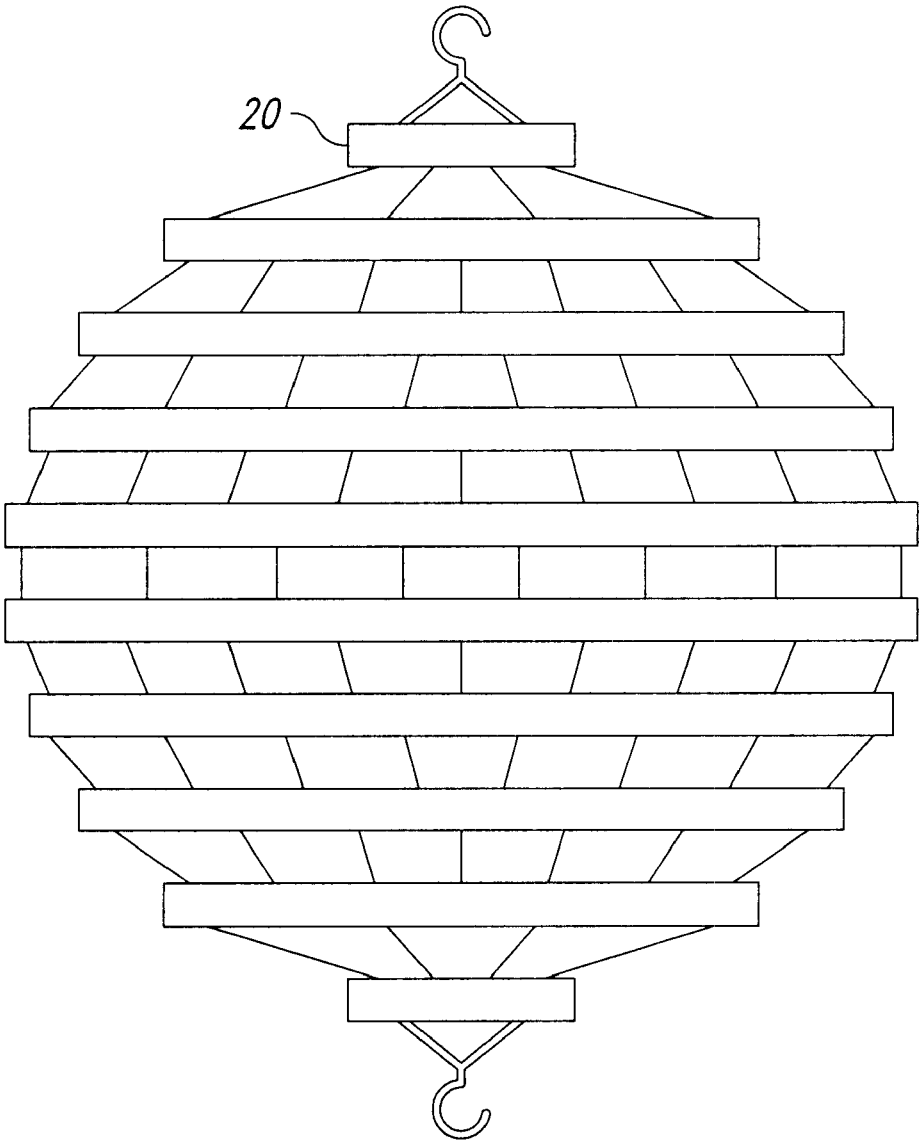

By varying the relative sizes of the rings or other selected mounting members, the light fixture may take on a variety of shapes when expanded to its active position. For example, the fixture may have a cylindrical configuration (FIG. 7), various conical shapes (FIGS. 8–9), an hour-glass configuration (FIG. 11), or a ball shape (FIG. 12). As previously indicated the rings 20, instead of being round, can be polygonal rings such, for example, as square rings or hexagonal rings.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A decorative light assembly comprising:

a plurality of independent frame members aligned on a central axis between a top one of the frame members and a bottom one of the frame members, each of the frame members being in the form of a closed loop surrounding the central axis;

elements movably coupling the frame members together such that the frame members can be moved in a direction parallel to said central axis between an operable position in which the frame members are spaced apart from each other, and an inoperable position in which the frame members are collapsed together;

a string of lights having a plurality of light units mounted on each of said frame members and electrically connected together by a flexible insulated wire extending between the frame members; and a device for suspending said frame members.

2. A decorative light assembly according to claim 1 in which said frame members are circular rings and each of said light units has a housing interfitting with a respective one of said circular rings and has a bulb projecting radially from said circular ring.

3. A decorative light assembly according to claim 1 in which said device comprises a hook.

4. A decorative light assembly according to claim 1 in which some of said frame members are circular.

5. A decorative light assembly according to claim 1 in which the top one of the frame members is a different size from the bottom one of the frame members.

6. A decorative light assembly according to claim 1 in which said frame members vary in size between said top and bottom of the frame members.

7. A decorative light assembly according to claim 1 in which said frame members are circular, said top and bottom of the frame members have the same diameter, and the frame members therebetween increase in diameter from said top and bottom of the frame members to a central one of the frame frame members.

8. A decorative light assembly according to claim 1 in which said top and bottom of the frame members are approximately the same size and said frame members therebetween decrease in size from said top and bottom of the frame members to a central one of the frame members.

9. A decorative light assembly according to claim 1 in which said top and bottom of the frame members are different in size, and said frame members therebetween are progressively smaller in size from the larger of said top and bottom of the frame members.

10. A decorative light assembly according to claim 1 in which at least some of said frame members are polygonal in shape.

11. A decorative light assembly according to claim 1 in which each of said frame members has inner and outer flanges, said outer flanges having cutouts to interfit with said light units, and said inner flanges having cutouts to interfit with said wire.

12. A decorative light assembly according to claim 1 in which eyes extend inwardly from each of said frame members and receive said elements.

* * * * *